US005383327A

United States Patent [19]

Dohln

[11] Patent Number: 5,383,327

[45] Date of Patent: Jan. 24, 1995

[54] THERAPEUTIC SADDLE FOR HANDICAPPED PERSONS

[76] Inventor: Guy V. Dohln, Rte. 2, Box 244, Rupert, Id. 83350

[21] Appl. No.: 116,851

[22] Filed: Sep. 7, 1993

[51] Int. Cl.[6] ..... B68C 1/02

[52] U.S. Cl. ..... 54/44.1

[58] Field of Search ..... 54/44.1, 44.3, 44.5, 54/46.1

[56] References Cited

U.S. PATENT DOCUMENTS 3,196,595 7/1965 McKeen, Jr. ..... 54/44.1

5,029,434 7/1991 Erickson ..... 54/46

FOREIGN PATENT DOCUMENTS 2552065 3/1985 France ..... 54/44.1

193524 12/1907 Germany ..... 54/44.1

*Primary Examiner*—Robert P. Swiatek

*Attorney, Agent, or Firm*—Hopkins, Roden, Crockett, Hansen & Hoopes

[57] ABSTRACT

A handicapped person's or child's restraining saddle having a quick-release feature that permits release of a waist belt, a chest strap, and a backrest. The quick-release is a hitch pin that passes through grommets in the belt and strap and then through a pair of aligned apertures in mating square tubes affixing the backrest to the saddle.

16 Claims, 3 Drawing Sheets

THERAPEUTIC SADDLE FOR HANDICAPPED PERSONS

BACKGROUND OF THE INVENTION

1. Field of the Invention

This invention relates to a therapeutic saddle for handicapped persons. The object of the invention is to provide a chest and back support, with built-in safety features provided by a releasable pin break-away system. An adult or child may be supported upon the animal within convenient reach and observation of the attendant on the ground leading the animal. In an emergency, the pin system may be extracted, and the rider and back support can be taken off by the attendant.

2. Discussion of the Prior Art

Various saddle-restraining devices have been provided by prior art disclosures to secure an individual to a horse or like animal. Exemplary is U.S. Pat. No. 5,029,434 ('434) issued to Erickson which discloses a harness and vest system for supporting a person by side straps and front and back straps buckled to a saddle. There is no removable backrest, and quick rider removal from the animal is not possible.

SUMMARY OF THE INVENTION

It is the purpose of this invention to provide a handicapped adult or child with a saddle and harness device that gently supports the person yet can be quickly disconnected by an attendant. In general, the invention is a restraining-saddle harness for a handicapped person comprising:

- a seat having a pommel on a forward end and a cantle on a back end;
- a pair of vertical structural members affixed to a back jockey behind the seat cantle;
- a pair of padded backrests removably affixed to the vertical structural member by a pin means;
- a waist belt removably affixed to the vertical structural member pin means;
- a padded chest pad having a bottom portion affixed to the waist belt and having a pair of chest straps, a chest strap first end removably affixed to a top portion of the chest pad; and
- a second end of the chest straps removably affixed to the vertical structural member pin means, wherein removal of a pin from the pin means releases the waist belts, the chest straps, and the backrests, thereby releasing a rider.

Other objects, advantages, and capabilities of the present invention will become more apparent as the description proceeds.

DETAILED DESCRIPTION OF THE PREFERRED EMBODIMENTS

Figure 1:
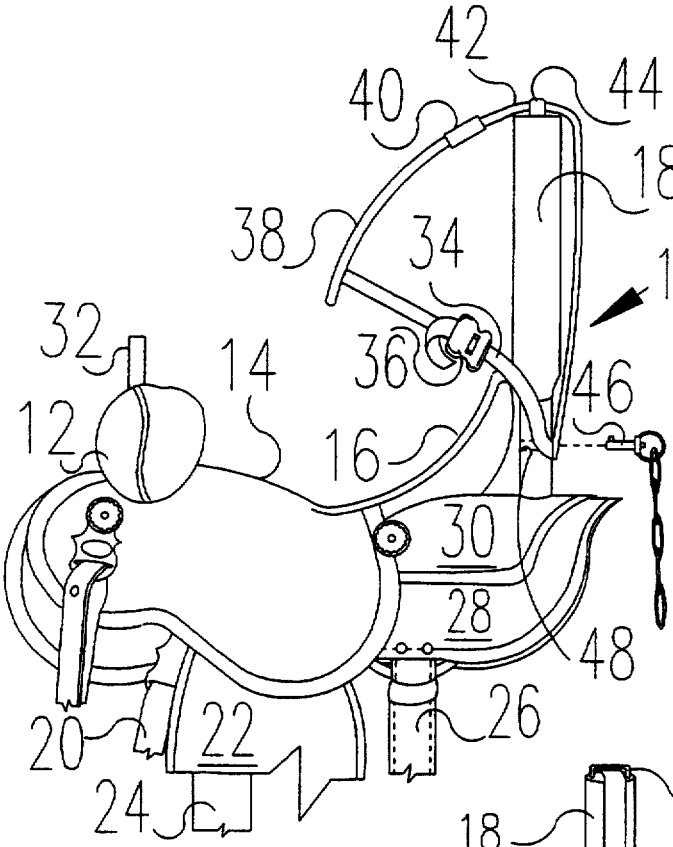
FIG. 1 is a side elevation of the therapeutic saddle.

FIG. 1 discloses the saddle 10 of the present invention having a pommel 12, seat 14, cantle 16, and the novel releasable backrests 18. As in most western saddles, there is a stirrup leather 20, a fender 22, front girth 24, and back girth 26. Additional conventional saddle parts are: padded skirt 28 beneath the back jockey 30. On this saddle pommel, there is a horizontal handle bar 32 for gripping by the rider.

Attaching to the backrests 18 are waist straps 34 and waist strap quick-disconnect buckles 36 which are, in turn, affixed to a padded-leather chest pad 38 having a pair of attached chest strap buckles 40 and chest straps 42. The chest straps pass through a pair of metal loops 44 at the top of padded rests 18 and are removably affixed at the base of rests 18 by hitch pins 46, which also restrain the pair of waist straps 34 when the pins 46 are inserted in the apertures 48 at the bottom of the rests 18.

Figure 2:
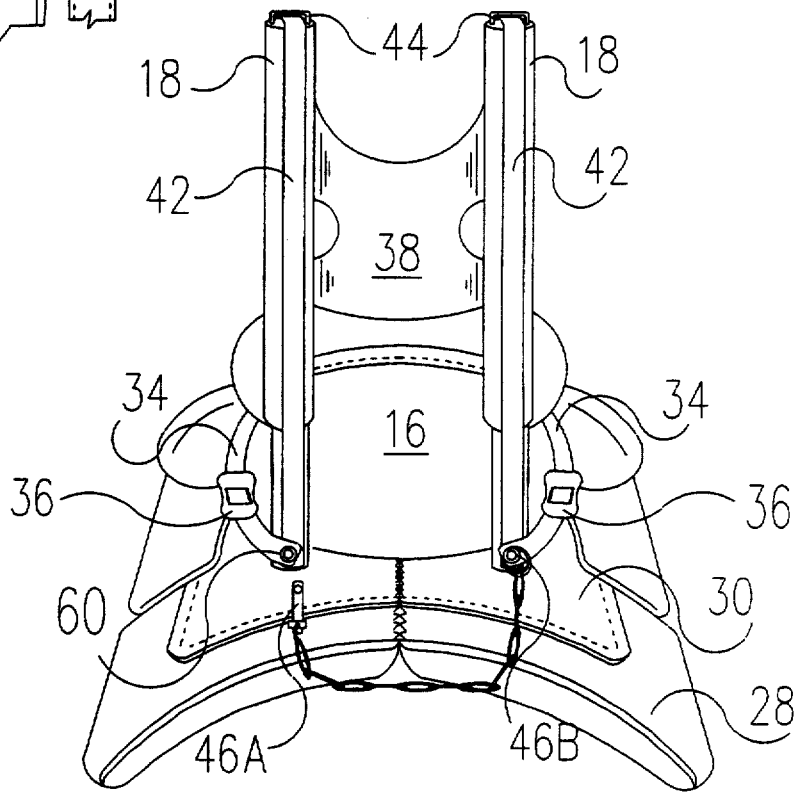
FIG. 2 is a rear elevation of the saddle.

In FIG. 2 (rear elevation), the pin 46A on the left is shown disengaged while pin 46B is shown engaged. The hitch pins have a protruding ball on one end that is normally raised, but retracts when a button on the other end is pushed allowing the pin to enter or exit the aperture.

Figure 3:
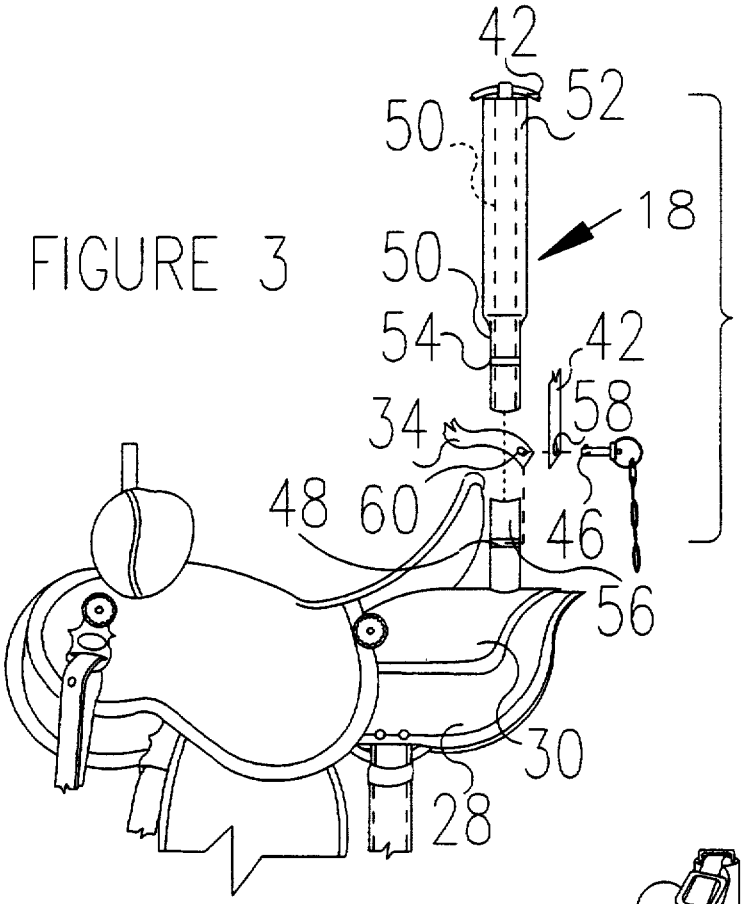
FIG. 3 is an exploded elevation view of the saddle.

Referring to FIG. 3, which shows the backrests 18 disengaged from the saddle 10, the method of attachment can be more easily seen. Backrests 18 consist of a structural member, i.e., square tube 50 within the padding 52 and having an aperture 54. The larger square tube 50 slides over a smaller square saddle tube 56 affixed under the saddle back jockey 30. The pins 46 affix the square tube 50 over saddle tube 56 by passing through backrest aperture 54 and saddle aperture 48. The pins 46 also restrain the waist straps 34 and chest straps 42 by passing through strap grommets 58 and 60. The saddle tubes 56 are welded to metal plates affixed to the tree (not shown) below back jockey 30.

Figure 4:
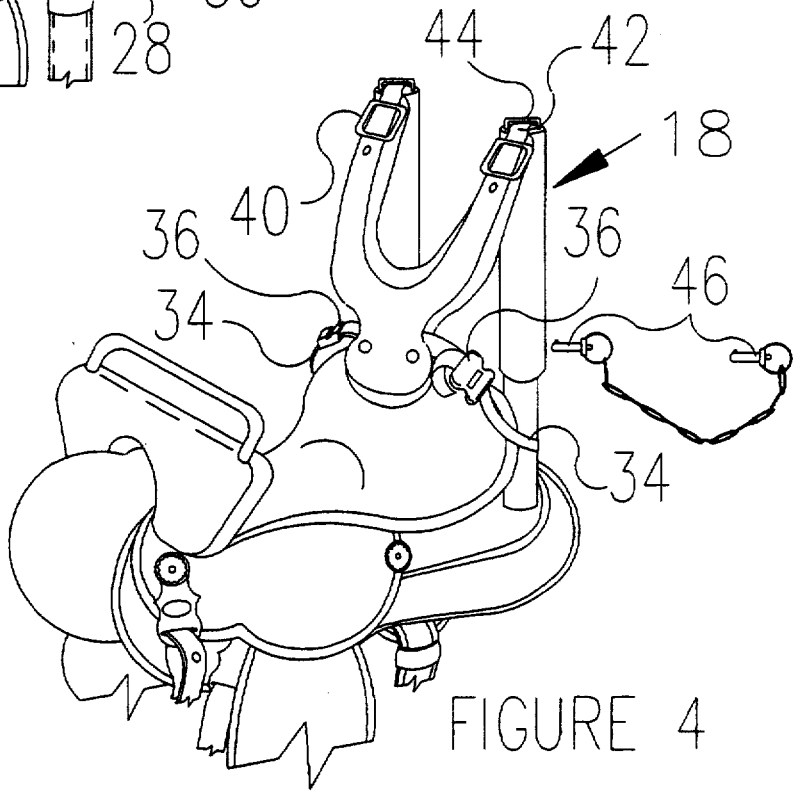
FIG. 4 is a front perspective view of the saddle.
Figure 5:
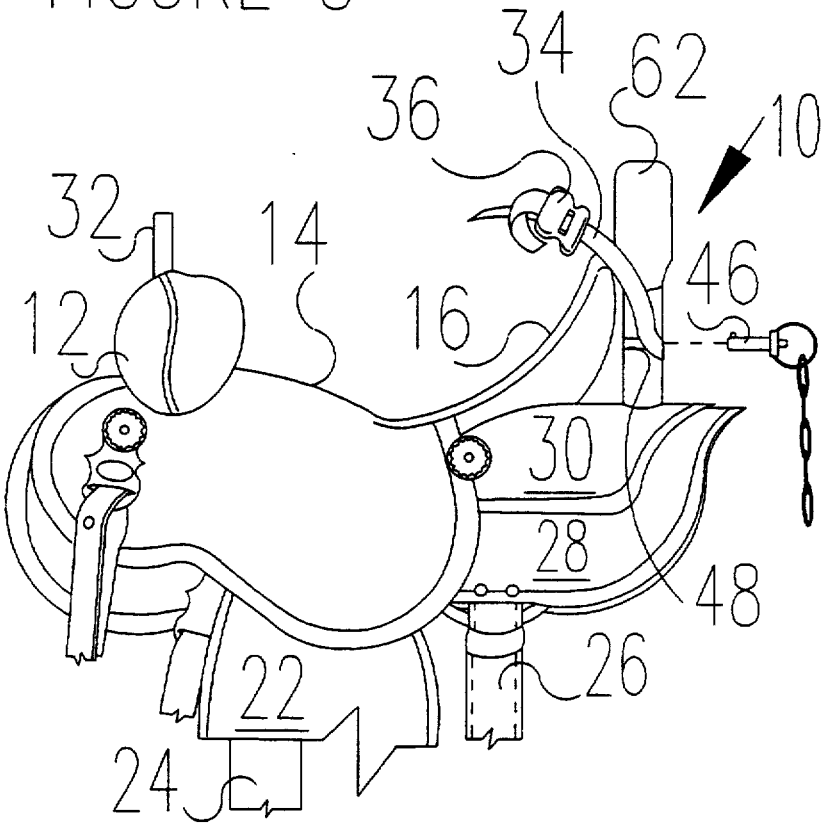
FIG. 5 is a side elevation of a second embodiment of the saddle.

In a second embodiment, a low backrest 62 is illustrated in FIG. 5 which has only a waist belt 34 and no chest pad or chest straps. The attachment means are the same using the pins 46 to engage the apertures 48. This embodiment also has a pair of backrests similar to the separate backrests, except lower, as seen in FIGS. 2 and 4.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. A restraining saddle for handicapped persons comprising:

a. a seat having a pommel on a forward end and a cantle on a back end;
b. a pair of vertical structural members affixed to a back jockey behind the seat cantle;
c. a pair of padded backrests removably affixed to the vertical structural members by a pair of pin means;
d. a pair of waist belts removably affixed to the vertical structural members by the pair of pin means;
e. a padded chest pad having a bottom portion affixed to the pair of waist belts and having a pair of chest straps, a chest strap first end removably affixed to a top portion of the chest pad; and
f. a second end of the chest straps removably affixed to the pair of pin means, wherein removal of a pin from the pin means releases the waist belts, the chest straps, and the backrests, thereby releasing a rider.

2. The saddle as described in claim 1 wherein the vertical structural members are a pair of vertical square tubes and the padded backrests each have a larger square tube that slides over the pair of vertical square tubes.

3. The saddle as described in claim 2 wherein each pin means further comprises:

a. push button hitch pin;

b. an aperture in the vertical structural member; and c. an aligning aperture in the larger square tube such that the hitch pin can be inserted through larger square tube aperture and the vertical square tube, thereby locking the tubes together.

4. The saddle as described in claim 3 wherein the waist belts and chest straps are retained by the hitch pin passing through a grommet in each belt and strap.

5. The saddle as described in claim 1 wherein a horizontal handle is affixed above the pommel.

6. The saddle as described in claim 1 wherein each waist belt has a pair of quick-disconnect adjustable buckles adjacent the chest pad and each chest strap having a quick-disconnect adjustable buckle adjacent the top portion of the chest pad.

7. The saddle as described in claim 1 wherein the waist belt has a quick-disconnect adjustable buckle.

8. A restraining saddle for handicapped persons comprising:

a. a seat having a pommel on a forward end and a cantle on a back end;

b. a pair of vertical square tubes affixed to a back jockey behind the seat cantle;

c. a pair of padded backrests, each having a larger square tube protruding therefrom, removably affixed to the vertical square tubes by a pair of pin means further comprising:

i. a push button hitch pin;

ii. an aperture in each vertical square tube; and iii. an aligning aperture in each larger square tube such that the hitch pin can be inserted through the larger square tube aperture and the vertical square tube aperture, thereby locking the tubes together;

d. a pair of waist belts removably affixed to each pin means;

e. a padded chest pad having a bottom portion affixed to each waist belt and having a pair of chest straps with chest strap first ends removably affixed to a top portion of the chest pad; and f. second ends of the chest straps removably affixed to the pin means, wherein removal of the hitch pin from the pin means releases each waist belt, the chest straps, and the backrests, thereby releasing a rider.

9. The saddle as described in claim 8 wherein the waist belts and chest straps are retained by the hitch pin passing through a grommet in each belt and strap.

10. The saddle as described in claim 8 wherein a horizontal handle is affixed above the pommel.

11. The saddle as described in claim 8 wherein each waist belt has a pair of quick-disconnect adjustable buckles adjacent the chest pad, and the chest straps each having a quick-disconnect adjustable buckle adjacent a top portion of the chest pad.

12. A restraining saddle harness for handicapped persons comprising:

a. a seat having a pommel on a forward end and a cantle on a back end;

b. a pair of vertical structural members affixed to a back jockey behind the seat cantle;

c. a pair of padded backrests removably affixed to the vertical structural members by a pair of pin means; and d. a waist belt removably affixed to the pair of pin means.

13. The saddle as described in claim 12 wherein the vertical structural members are a pair of square tubes and the padded backrests each have a larger square tube that slides over the pair of one of square tubes.

14. The saddle as described in claim 13 wherein each pin means further comprises:

a. a push button hitch pin;

b. an aperture in each of the vertical structural members; and c. an aligning aperture in each of the larger square tubes such that the hitch pin can be inserted through larger square tube aperture and the structural square tube aperture, thereby locking the tubes together.

15. The saddle as described in claim 14 wherein the waist belt is retained by the hitch pin passing through a grommet in opposing ends of the belt.

16. The saddle as described in claim 12 wherein a horizontal handle is affixed above the pommel.

* * * * *